United States Patent [19]

Soofi

[11] Patent Number: 5,072,916

[45] Date of Patent: Dec. 17, 1991

[54] TUNDISH IMPACT PAD

[75] Inventor: Madjid Soofi, St. Charles, Ill.

[73] Assignee: Magneco/Metrel, Inc., Addison, Ill.

[21] Appl. No.: 530,164

[22] Filed: May 29, 1990

[51] Int. Cl.[5] ..... C21B 3/00

[52] U.S. Cl. ..... 266/275; 266/287

[58] Field of Search ..... 266/275, 287, 229, 230, 266/227, 236; 164/362, 337, 335, 437

[56] References Cited

U.S. PATENT DOCUMENTS

| | | | |
|---|---|---|---|
| 1,727,565 | 9/1929 | Schall | 164/362 |
| 2,301,880 | 11/1942 | Johnston, Jr. | 266/278 |
| 2,406,380 | 8/1946 | Johnston, Jr. | 266/278 |
| 3,887,171 | 6/1975 | Neuhaus | 266/275 |
| 4,033,546 | 7/1977 | Guegan | 249/174 |
| 4,177,855 | 12/1979 | Duchateau et al. | 266/275 |
| 4,209,162 | 6/1980 | Petiau | 164/362 |
| 4,715,786 | 12/1987 | Schmidt et al. | 266/275 |

FOREIGN PATENT DOCUMENTS

| | | | |
|---|---|---|---|
| 2643009 | 3/1978 | Fed. Rep. of Germany | 266/287 |
| 7425230 | 7/1974 | France . | |
| 0008534 | 3/1978 | Japan | 164/337 |
| 0002539 | 1/1988 | Japan | 164/437 |

*Primary Examiner*—S. Kastler

*Attorney, Agent, or Firm*—Willian Brinks Olds Hofer Gilson & Lione

[57] ABSTRACT

A tundish impact pad is provided for use in a tundish vessel. The impact pad has a wavy upper surface which significantly reduces the horizontal surface area in the region of impact where molten iron or steel enters the tundish vessel. This wavy surface substantially reduces the vertical splashing of molten iron or steel entering the vessel, causing a significant reduction in agitation and turbulence within the vessel. The impact pad may exist as a discrete structure or may form an integral part of the structure of the tundish vessel.

8 Claims, 3 Drawing Sheets

2
12
110
TO MOLD
120
103
100
152
154
102
150
18
10
14
12
160
16
108

110
120
103
104
106
12
18
10
102
22
20
16
108
100

TUNDISH IMPACT PAD

FIELD OF THE INVENTION

This invention relates to an impact pad used in a tundish vessel for the purpose of reducing turbulence caused by pouring molten iron or steel into the tundish vessel.

BACKGROUND OF THE INVENTION

In a tundish vessel of the type used in the iron and steel industry, there are typically variations in the purity of the molten iron or steel contained therein. When the molten iron or steel is in a nonagitated, nonturbulent state, impurities in the molten material tend to float to the top of the molten material causing formation of a so-called "slag" layer. In other words, the purest of the molten iron or steel exists near the bottom of the vessel.

Molten iron or steel is poured into the tundish vessel from the top, and exits at the bottom. By maintaining a sufficient level of molten iron or steel in the vessel, and a sufficient residence time to allow impurities to float to the top, the concentration of impurities is reduced to a minimum in the lowermost portion of the vessel where the molten material leaves the vessel for further processing. Problems associated with impurities occur, however, when the pouring of molten iron or steel into the tundish from the top creates sufficient agitation and turbulence that some of the slag material is forced downward into the lowermost portion of the tundish vessel, or is prevented from rising.

Various methods and devices have been invented for the purpose of reducing turbulence in a tundish vessel caused by the pouring of molten iron or steel into the vessel. In U.S. Pat. No. 4,177,855, a pair of swinging doors is shown which helps protect the slag layer from turbulence caused by the pouring of molten metal. A flat impact pad provides an elevated splashing surface which helps contain most of the turbulence between the swinging slabs. U.S. Pat. No. 4,042,229 discloses the use of a first pair of sidewalls adjacent a flat impact pad and a second pair of sidewalls separating the slag from the pouring areas, for separating the region of turbulence from the slag layer.

German Patent 26 43 009 discloses the use of a splash plate which contains, as part of the pad, a plurality of very small sidewalls arranged in a honeycomb configuration.

While the various prior art devices have helped contain the area of turbulence horizontally, using various sidewalls, none of these devices has the purpose or function of eliminating or substantially reducing vertical splashing. Hence, while the agitation and turbulence have been somewhat contained, they have not, until now, been substantially reduced.

SUMMARY OF THE INVENTION

With the foregoing in mind, it is an object of the invention to provide an impact pad for a tundish vessel which substantially reduces the vertical splashing associated with the pouring of molten iron or steel into the tundish vessel.

A further object of this invention is to substantially reduce the agitation and turbulence of molten iron or steel present in the tundish vessel, when additional molten iron or steel is poured into the vessel.

A further object of the invention is to improve the purity of the molten iron or steel exiting from the bottom of the tundish vessel.

In accordance with the invention, it has been found that vertical splashing, agitation and turbulence can be substantially reduced by providing a tundish impact pad which is configured with a wavy upper surface. The waves may be sinusoidal, triangular, or irregular, with the only limitation being that the waves must be configured to significantly reduce the horizontal flat areas present in the upper surface of the impact pad. Vertical splashing, and the resulting agitation and turbulence, are maximized when the impact surface is completely horizontal and flat.

By reducing the horizontal flat areas in the floor of the tundish and, in particular, in that portion of the floor which experiences the greatest impact from the pouring of molten steel, the amount of vertical splashing can be significantly reduced. In accordance with the invention, this is accomplished by providing an impact pad having a wavy surface, in the region of impact. The waves are configured so as to cause significant portions of the impact surface to be slanted from the horizontal. This can be accomplished using triangular, sinusoidal, or certain other wave patterns.

The foregoing objects and embodiments are more clearly illustrated in the following detailed description made with reference to the accompanying figures.

BRIEF DESCRIPTION OF THE FIGURES

FIG. 4(*b*) is a front cross-sectional view of a second embodiment of the tundish impact pad shown in FIG. 3. In this embodiment, the sinusoidal waves exist in both the "x" and "z" directions.

FIG. 5(*b*) is a perspective view of the embodiment of the tundish impact pad shown in FIGS. 3 and 4(*b*). having sinusoidal waves in both the "x" and "z" directions.

DETAILED DESCRIPTION OF THE PRESENTLY PREFERRED EMBODIMENTS

Figure 1:
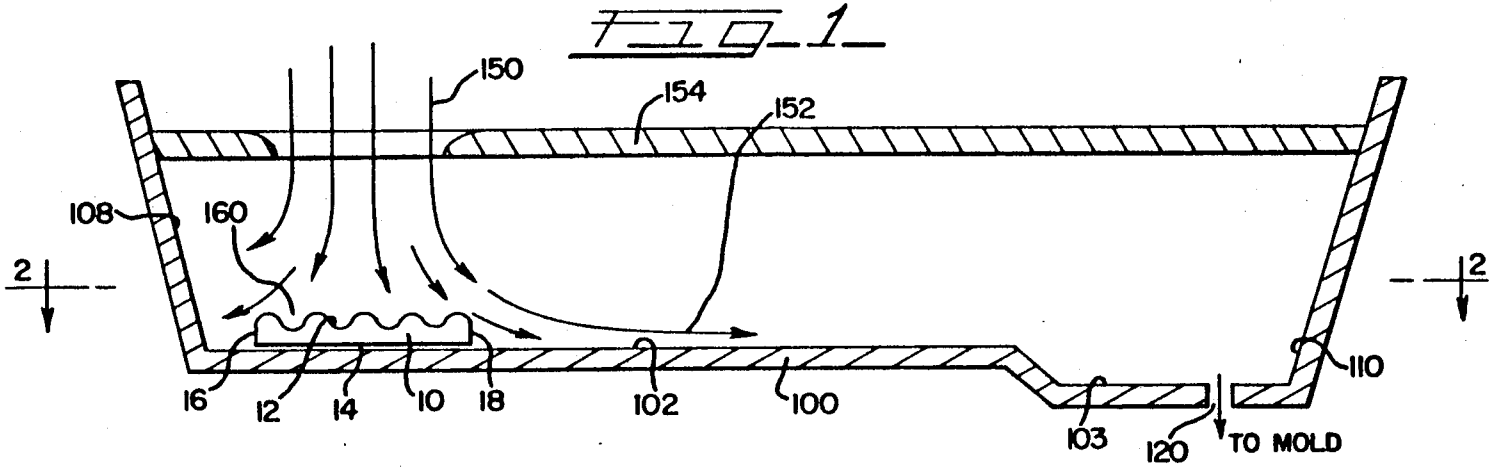
FIG. 1 is a side cross-sectional view of a tundish impact pad of the invention, located on the floor of a tundish vessel in the region of impact.
Figure 2:
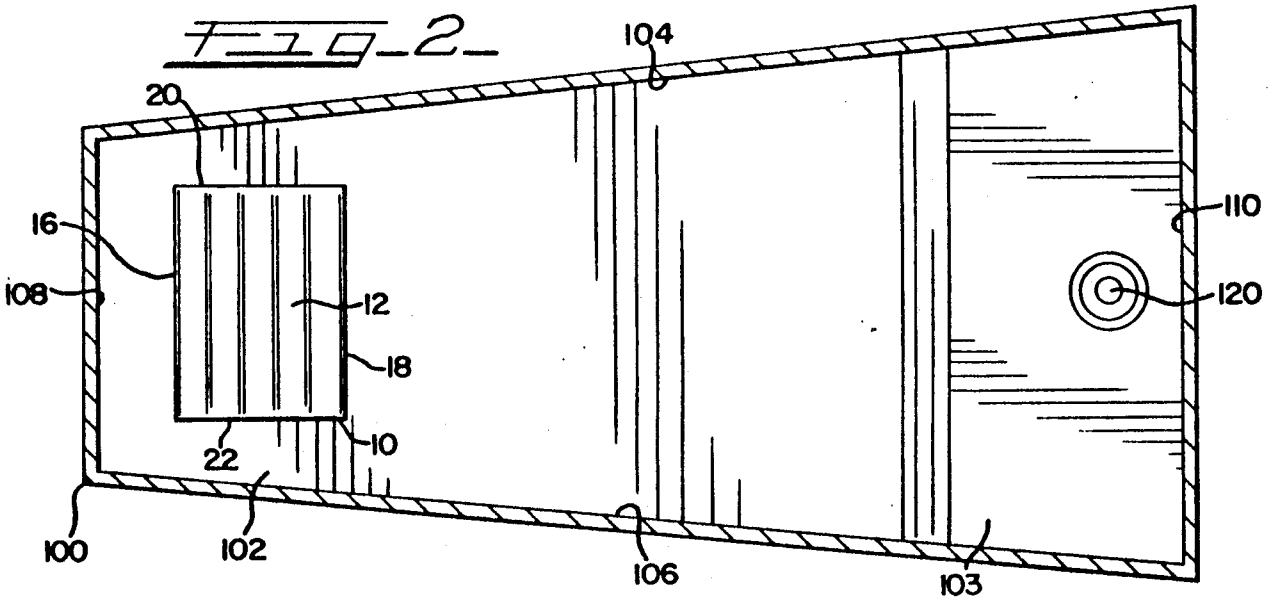
FIG. 2 is a top plan view of the tundish impact pad and tundish vessel of FIG. 1.
Figure 5A:
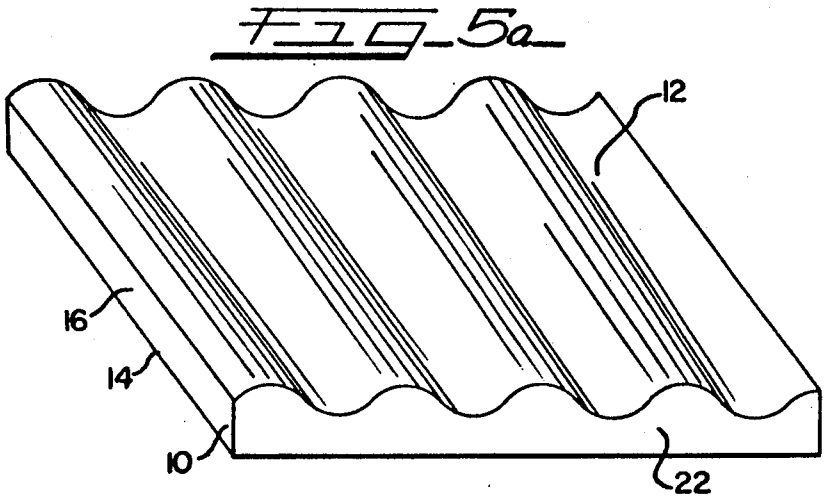
FIG. 5(*a*) is a perspective view of the embodiment of the tundish impact pad shown in FIGS. 3 and 4(*a*). having sinusoidal waves in the "x" direction but not in the "Z" direction.
Figure 5B:
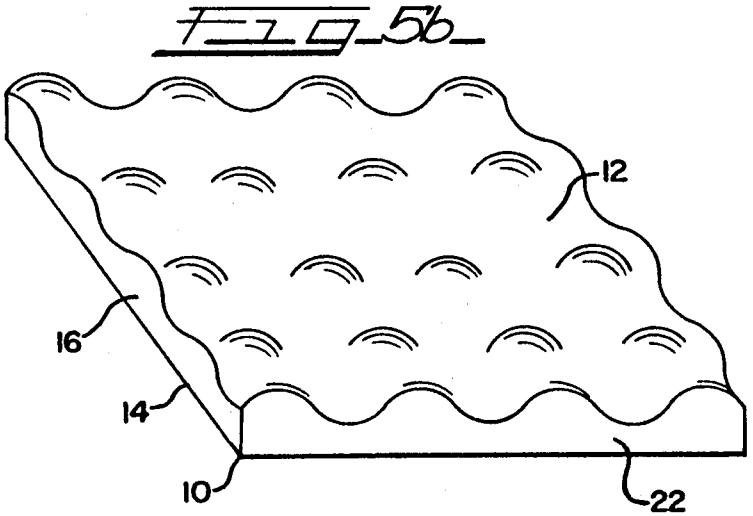

Referring first to FIGS. 1 and 2, a tundish impact pad 10 of the invention is positioned on the floor 102 of a tundish vessel 100 in the region of impact 160. The tundish impact pad 10 comprises a wavy upper surface 12, located in the path of flow of the molten steel 150 entering the tundish vessel 100 from a ladle (not shown). The tundish impact pad also has a substantially flat, substantially rectangular lower surface 14 for supporting the impact pad 10, and four side surfaces 16, 18, 20 and 22 extending between the wavy upper surface 12 and the support surface 14.

The tundish impact pad 10 is constructed from a high temperature-resistant refractory composition which is capable of withstanding continuous exposure to molten iron or steel at temperatures of up to 3000 degrees Fahrenheit. Preferably, the impact pad is constructed from a refractory material containing about 60–85 percent by weight $A1_2O_3$, 38–13 percent by weight $SiO_2$, 0.9–0.5 percent by weight CaO. and 1–0.5 percent by weight $Fe_2O_3$. Other suitable refractory materials include MgO, SiC, $Cr_2O_3$, and $ZrO_2$. The composition of the impact pad is not limited to the named materials. Any refractory material can be used, so long as the impact pad will be capable of withstanding continuous, long-term exposure to molten iron or steel.

The tundish vessel is also constructed from a suitable refractory composition and includes four side walls 104. 106, 108 and 110, surrounding and extending upward from the floor 102. The floor 102 has a depressed portion 103, located at an end of the vessel opposite the region of impact 160 for the entering molten steel 150. A drain 120 is located in the depressed portion 103. Molten steel passes through the drain 120 and to the next processing location, usually a mold (not shown).

The molten steel within the tundish vessel 100 includes a substantially pure phase 152 located near the bottom of the vessel 100, and a slag layer 154 located near the top which contains a much higher concentration of impurities. The entering molten steel 150 causes some disruption of the slag layer 152, forcing some of the slag material toward the bottom of the vessel. Therefore, the tundish vessel 100 must be designed such that there is sufficient residence time in the vessel to allow impurities in the molten steel to float to the top of the steel, between the time the molten steel enters at the impact region 160 and the time it exits through the drain 120 in the depressed portion 103. The amount of molten steel in the tundish vessel 100 must also be maintained at a sufficient level to allow adequate separation between the slag material 154 and the substantially pure phase 152 existing near the bottom of the vessel.

Figure 3:
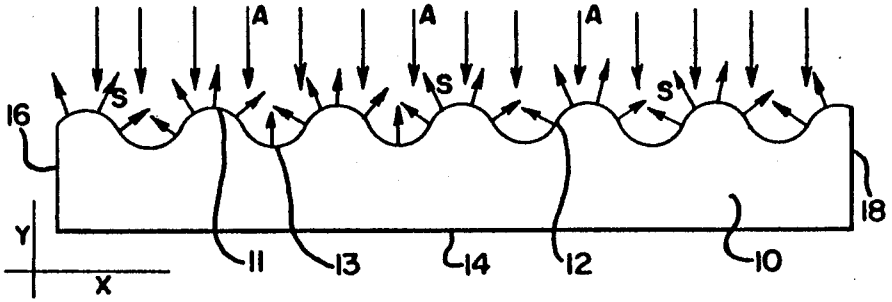
FIG. 3 is an exploded side cross-sectional view of a tundish impact pad of the invention which illustrates the direction of impact and directions of splashing using arrows.

The tundish impact pad 10 of the invention forms part of the overall design of the tundish vessel 100 and results in a much improved design for the vessel by reducing the splashing and turbulence caused by the pouring of molten steel 150 into the vessel. FIG. 3 illustrates how the impact pad 10 causes substantial reduction in vertical splashing. The vectors A represent the downward forces caused by the pouring of molten steel 150 into the vessel 100. The vectors S represent the splashing forces created when the molten steel 150 comes into contact with the impact pad 10.

If the upper surface 12 of the impact pad 10 were completely flat and horizontal, or if the tundish vessel did not contain an impact pad 10, then the splashing forces S would be substantially vertical at all points. These vertical forces S would directly oppose the downward forces A caused by the pouring of molten steel, resulting in the highest possible agitation and turbulence inside the tundish vessel 100. This agitation and turbulence would significantly disturb the slag layer 154 and would make it difficult for impurities in the vessel to rise to the surface of the molten steel. This problem was faced in the iron and steel industry prior to the invention of the tundish impact pad described herein.

Through use of the tundish impact pad 10 shown in FIG. 3, the substantially vertical splashing forces can be eliminated at all points in the region of impact except at the uppermost points 11 and the lowermost points 13 of the wavy surface 12. At all points in between, the splashing forces S are slanted to the left or right as shown in FIG. 3, and do not significantly oppose the downward forces A of the entering molten steel 150. The result is that overall vertical splashing, agitation and turbulence are significantly reduced. This in turn results in less disruption of the slag layer 154 and greater purification of the lowermost portion 152 of the molten steel in the vessel.

In the embodiment shown in FIG. 3, the upper surface 12 of the impact pad 10 varies in a sinusoidal fashion according to the equation:

$$y=a+b\sin(cx-d),$$

where y is the height of the surface 12, x is the horizontal distance along the surface 12 of the impact pad 10, from back to front, and a, b, c and d are constants which affect the height of the waves, the length of the waves, and the configuration of the waves near the edges of the impact pad 10.

Figure 4A:
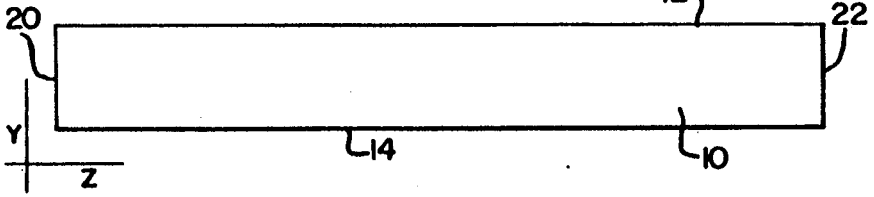
FIG. 4(*a*) is a front cross-sectional view of one embodiment of the tundish impact pad shown in FIG. 3. In this embodiment, the sinusoidal waves exist in the "x" direction and not in the "z" direction.
Figure 4B:
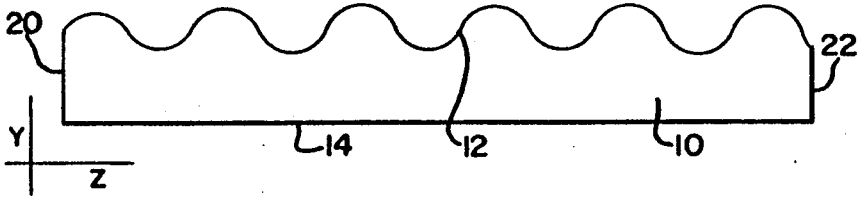

FIGS. 3. 4(*a*) and 5(*a*) define a first embodiment in which the height of the upper surface 12 is varied only in a single direction. Thus, the sine waves in the upper surface 12 appear only along the x-axis. As shown in FIG. 4(*a*). the upper surface 12 appears horizontal and flat in the "z" direction.

Figure 6:
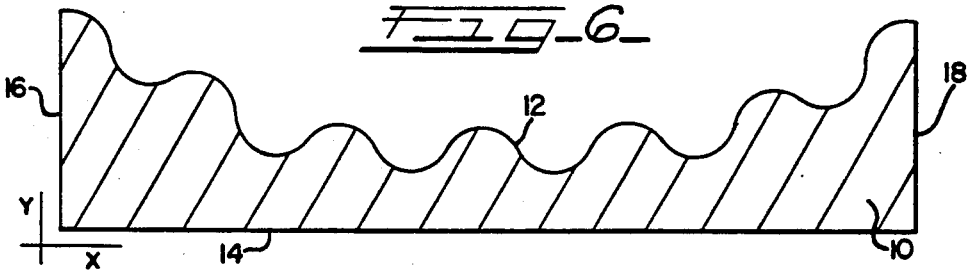
FIG. 6 is a side cross-sectional view of a third embodiment of the tundish impact pad of the invention, in which the waves are irregular.

In order to cause even further reduction in vertical splashing, the horizontal areas of the wavy surface 12 can be further reduced by varying the height of the surface 12 in more than one direction. In the second embodiment defined by FIGS. 3. 4(*b*) and 5(*b*). the sine waves in the surface 12 appear along both the x-axis and the z-axis. In this second embodiment of the tundish impact pad 10 of the invention, the wavy upper surface 12 can be described according to the equations:

$$y=a+b(cx-d), \text{ and}$$

$$y=p+q\sin(rz-s),$$

whereby y is the height of the surface 12, x is the horizontal distance along the surface 12 of the impact pad, from back to front, z is the horizontal distance along the surface 12 of the impact pad, from side to side.

a, b, c and d are constants which determine the height, length and configuration of the waves in the x direction, and p, q, r and s are constants which determine the height, length and configuration of the waves in the z direction, Various other wave configurations for the upper surface 12 of the impact pad 10 of the invention can also be employed. In FIG. 6, a third embodiment is shown in which the wavy surface 12 varies irregularly, with the wavy surface being lower near the center of the impact pad 10 than near the sides 16 and 18. This embodiment of the invention helps contain the splashing and turbulence horizontally as well as reducing the vertical splashing of molten steel entering the tundish vessel.

Figure 7:
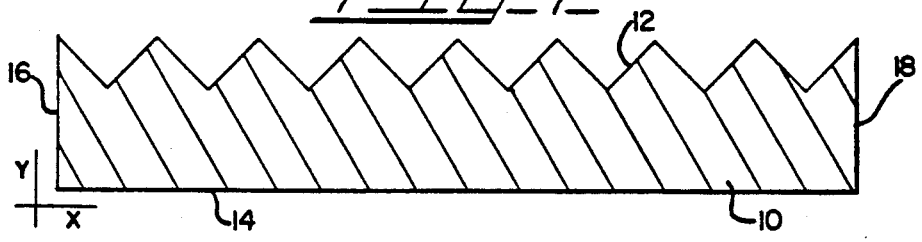
FIG. 7 is a side cross-sectional view of a fourth embodiment of a tundish impact pad of the invention, in which the waves are triangular.

FIG. 7 illustrates the use of triangular waves instead of sine waves in the upper surface 12 of the impact pad 10 of the invention. Other wave configurations not shown can also be employed, provided that the wavy surface 12 is configured so as to significantly reduce the flat horizontal surface area in the impact region 160 of the tundish vessel. Square waves, for example, do not constitute an embodiment of the invention because an impact pad having square waves on its upper surface would have just as much horizontal surface area as an impact pad whose upper surface is completely flat.

Figure 8:
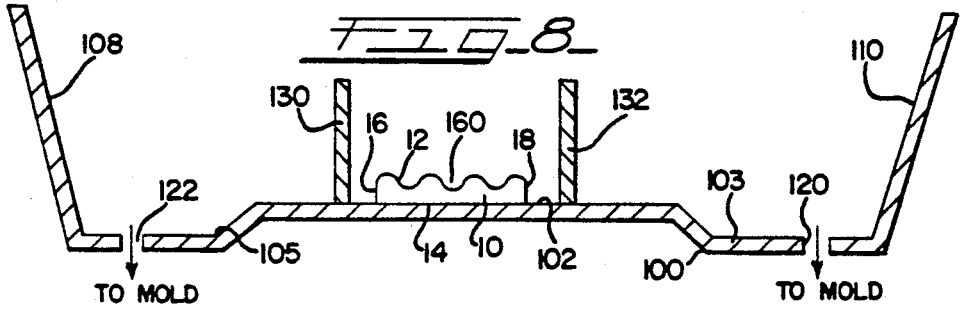
FIG. 8 is a side cross-sectional view of a tundish impact pad of the invention, used in conjunction with weirs to further reduce and contain the turbulence.

The impact pad 10 of the invention may be used in conjunction with prior art methods and devices to cause even further reduction in splashing, agitation and turbulence inside the tundish vessel. In FIG. 8, for example, the tundish impact pad 10 is located between two weirs 130 and 132 which help contain the splashing and turbulence to the impact region 160 inside the tundish vessel 100. In this case, the tundish vessel 100 has depressed regions 103 and 105 located at both ends of the floor 102 of the tundish vessel 100. Both depressed regions have drains 120 and 122, respectively.

The impact region 160 for the entering molten steel is located centrally between the depressed regions 103 and 105 in FIG. 8. As molten steel enters the tundish vessel 100, the impact pad 10 significantly reduces vertical splashing, agitation and turbulence. The weirs 130 and 132 help contain any splashing agitation or turbulence which nevertheless occurs, within the impact region 160 of the vessel 100.

Figure 9:
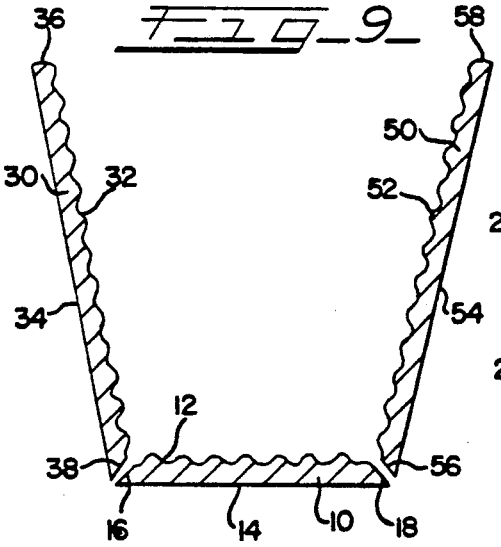
FIG. 9 is a front cross-sectional view of a tundish impact pad arrangement designed to cover the floor and sidewalls of a tundish vessel.

In a highly preferred embodiment of the invention, tundish impact pads may be designed for covering both the floor and sidewalls in the impact region of a tundish vessel. FIG. 9 illustrates an arrangement of three impact pads 10. 30 and 50 designed and arranged to cover the floor and sides of a tundish. The impact pad 10 has an upper wavy surface 12 for reducing vertical splashing, and a lower surface 14 for support. The impact pad 10 also has two slanted side surfaces 16 and 18 which are designed and arranged to interface with the slanted side surfaces 38 and 56 on the adjacent impact pads 30 and 50, respectively. The impact pad 10 is designed to cover the floor of a tundish vessel, at least in the region of impact.

The impact pads 30 and 50 are each designed to cover one side of the tundish vessel. Each impact pad has a wavy surface (32, 52) which significantly reduces any splashing, agitation or turbulence that may result from molten steel being directed against the sidewalls of the tundish vessel. Each impact pad also has a support surface (34, 54) for supporting the impact pads (30, 50) against the respective sidewalls of the tundish vessel, and edges (36, 38, 56 and 58) which extend between the wavy surfaces (32, 52) and the support surfaces (34, 54).

Figure 10:
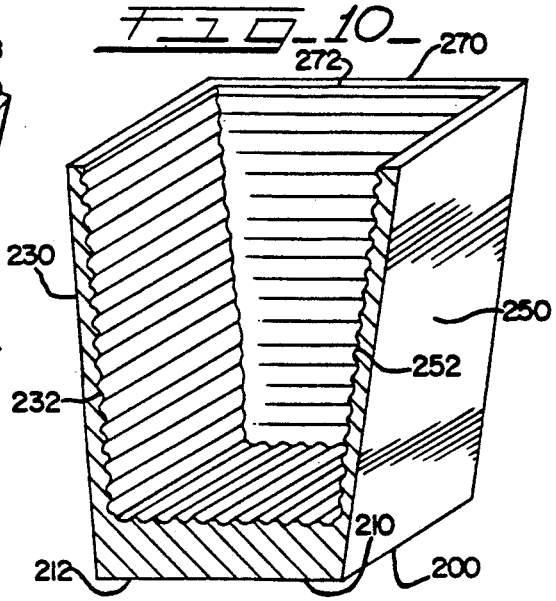
FIG. 10 is a perspective cross-sectional view of a tundish vessel in which tundish impact pads of the invention have been integrated into both the floor and the sidewalls of the tundish vessel.

The tundish impact pad of the invention may exist as a separate device for placing inside a tundish vessel or may, alternatively, be integrated into the structure of the tundish vessel. FIG. 10 illustrates an embodiment in which tundish impact pads 210, 230. 250 and 270 are integrated into the floor and sidewalls of the tundish vessel 200. The impact pads have wavy surfaces 212. 232. 252 and 272 which in this case define the floor and sidewalls of the tundish vessel.

While the foregoing embodiments of the invention are at present considered to be preferred, it is understood that the invention is not limited to the disclosed examples. Various modifications in addition to those discussed can be made without departing from the spirit and scope of the invention. The scope of the invention is indicated in the appended claims, and all modifications and improvements that fall within the meaning and range of equivalency of the claims are intended to be embraced therein.

I claim:

1. In a tundish vessel used in the iron and steel industry having a floor, a back wall, a front wall, two sidewalls, a region of impact, and a drain, the improvement comprising an impact pad having a wavy upper surface located on the floor of the tundish vessel, the wavy surface being configured to reduce the horizontal surface area on the floor of the vessel, and one or more additional impact pads located on the sidewalls of the tundish vessel.

2. In a tundish vessel used in the iron and steel industry having a floor, a back wall, a front wall, two sidewalls, a region of impact, and a drain, the improvement comprising an impact pad having a wavy upper surface forming part of the integral structure of the floor of the tundish vessel, the wavy surface being configured to reduce the horizontal surface area on the floor of the vessel, and one or more additional impact pads forming part of the integral structure of the sidewalls of the tundish vessel.

3. The tundish vessel of claim 1 further comprising an additional impact pad located on the back wall of the tundish vessel.

4. The tundish vessel of claim 2 further comprising an additional impact pad forming part of the integral structure of the back wall of the tundish vessel.

5. In a tundish vessel used in the iron and steel industry having a floor, a back wall, a front wall, two side walls, a region of impact, and a drain, the improvement comprising an impact pad having a sinusoidal upper surface located on the floor of the tundish vessel in the region of impact where molten material enters the tundish vessel, and one or more additional impact pads located on the sidewalls of the tundish vessel.

6. The tundish vessel of claim 5 further comprising an additional impact pad located on the back wall of the tundish vessel.

7. In a tundish vessel used in the iron and steel industry having a floor, a back wall, a front wall, two sidewalls, a region of impact, and a drain, the improvement comprising an impact pad having a sinusoidal upper surface forming part of the integral structure of the floor of the tundish vessel in the region of impact where molten material enters the tundish vessel, and one or more additional impact pads forming part of the integral structure of the sidewalls of the tundish vessel.

8. The tundish vessel of claim 7 further comprising an additional impact pad forming part of the integral structure of the back wall of the tundish vessel.

* * * * *